US008523599B2

(12) United States Patent
Lazzaro

(10) Patent No.: US 8,523,599 B2
(45) Date of Patent: Sep. 3, 2013

(54) PLUG DEVICE HAVING A CLOSURE UNIT

(75) Inventor: Volker Lazzaro, Kirchhundem (DE)

(73) Assignee: Amad Mennekes Holding GmbH & Co. KG, Kirchhundem (DE)

( * ) Notice: Subject to any disclaimer, the term of this patent is extended or adjusted under 35 U.S.C. 154(b) by 0 days.

(21) Appl. No.: 13/504,687

(22) PCT Filed: Oct. 20, 2010

(86) PCT No.: PCT/EP2010/065804
§ 371 (c)(1),
(2), (4) Date: Apr. 27, 2012

(87) PCT Pub. No.: WO2011/051150
PCT Pub. Date: May 5, 2011

(65) Prior Publication Data

US 2012/0208384 A1 Aug. 16, 2012

(30) Foreign Application Priority Data

Oct. 28, 2009 (DE) ..... 10 2009 044 343

(51) Int. Cl.
*H01R 13/453* (2006.01)

(52) U.S. Cl.
USPC ..... 439/439

(58) Field of Classification Search
USPC ..... 439/138–139
See application file for complete search history.

(56) References Cited

U.S. PATENT DOCUMENTS

| | | | | |
|---|---|---|---|---|
| 2,752,581 | A * | 6/1956 | Benander | 439/139 |
| 3,980,372 | A * | 9/1976 | Ranzanigo | 439/139 |
| 4,758,536 | A | 7/1988 | Miller et al. | |
| 5,267,870 | A * | 12/1993 | Maresh | 439/139 |
| 5,902,140 | A * | 5/1999 | Cheung et al. | 439/139 |
| 7,452,221 | B1 * | 11/2008 | Oddsen et al. | 439/137 |
| 7,525,042 | B2 | 4/2009 | Lazzaro | |
| 2003/0001715 | A1 | 1/2003 | Montague | |

FOREIGN PATENT DOCUMENTS

| | | |
|---|---|---|
| EP | 2 075 889 A2 | 7/2009 |
| GB | 2 125 232 A | 2/1984 |

* cited by examiner

*Primary Examiner* — Truc Nguyen
(74) *Attorney, Agent, or Firm* — Henry M Feiereisen LLC

(57) ABSTRACT

An electrical plug device has a contact module in which a complimentary plug device element can be inserted from an access site along a insertion axis. The plug device includes a closure unit having one or more cover elements which move from a rest position to an open position when the complimentary plug device element is inserted. The cover elements may have sloped guide surfaces and can be radially urged apart from each other.

14 Claims, 3 Drawing Sheets

PLUG DEVICE HAVING A CLOSURE UNIT

CROSS-REFERENCES TO RELATED APPLICATIONS

This application is the U.S. National Stage of International Application No. PCT/EP2010/065804, filed Oct. 20, 2010, which designated the United States and has been published as International Publication No. WO 2011/051150 A1 and which claims the priority of German Patent Application, Serial No. 10 2009 044 343.6, filed Oct. 28, 2009, pursuant to 35 U.S.C. 119(a)-(d).

BACKGROUND OF THE INVENTION

The invention relates to an electrical plug device with having a contact module which has an access side that is plugged by a closure device when not in use. The invention further relates to a closure device and to a method for protecting the access side of the contact module of an electrical plug device.

Electrical plug devices, for example plugs or couplings for high currents according to DIN VDE 0623, EN 60309-2 ("CEE plug devices") or according to IEC 62196 ("E-auto charging plug devices") typically include a contact module with electrical contacts (pins or sockets) in a housing. A complimentary plug device element (coupling or plug) can be inserted into the contact module from an access side for establishing electrical contact to the contact elements. It is known to provide the access side of such plug devices with a hinged cover to protect the plug devices against intrusion of dirt and humidity when not in use and to prevent accidental contact with the current-carrying components. Before a complimentary plug device element is inserted, such hinged cover must be manually changed to an open position by the user.

With this background in mind, it was an object of the present invention to provide an electrical plug device with a protection mechanism having improved safety and/or comfort.

SUMMARY OF THE INVENTION

According to one aspect of the invention, the object is attained with an electrical plug device having a contact module with an access side configured for insertion of a complimentary plug device element into the contact module through movement of the complimentary plug device element along an insertion axis; and a closure device having at least one cover element configured for movement from a rest position, where the cover element covers the access side of the contact module, into an open position, where the cover element uncovers the access side when the complimentary plug device element is inserted into the contact module.

According to another aspect of the invention, the object is attained with a closure device for a plug device. The plug device has a contact module with an access side configured for insertion of a complimentary plug device element into the contact module through movement of the complimentary plug device element along an insertion axis. The closure device includes at least one cover element being pivotally supported about a pivot axis that is parallel to the insertion axis and comprising a sliding surface positioned at an angle with respect to the insertion axis, wherein the at least one cover element being configured for movement from a rest position, where the cover element covers the access side of the contact module, into an open position, where the cover element uncovers the access side when the complimentary plug device element is inserted into the contact module. The complimentary plug device element contacts the sliding surface when inserted into the contact module. Advantageous embodiments are recited in the dependent claims.

The electrical plug device according to the invention, which is mainly a coupling or an outlet or a plug, includes the following components:

a) A contact module with an access side, at which a complimentary plug device element can be inserted into the contact module by moving it along a insertion axis. The contact module typically includes electrically conducting, metallic contact elements, such as sockets or pins, which are supported in an insulating support and accessible from the access side.

b) A closure device with at least one cover element, which is moved from a rest position into an open position when the aforementioned complimentary plug device elements is inserted into the contact module. The cover element should (completely or partially) cover the access side of the contact module in the rest position, while uncovering the access side in the open position for insertion of a complimentary plug device element.

Preferably, the cover element covers in the rest position the entire access side and not only individual openings leading to the contact elements. Moreover, two or more cover elements are typically provided, wherein reference to "the cover element" is intended to always refer here and in the following description to all cover elements present in such greater numbers.

The invention also relates to a closure device according to the feature b) of the electrical plug device of the aforementioned type, because the closure device represents a separate component for such plug device. All claims and/or statements directed to an electrical plug device therefore apply also to the closure device.

The invention also relates to a method for protecting the access side of the contact element of an electrical plug device, in particular of a plug device of the aforedescribed type. According to the method, at least one cover element is provided in front of the access side, which covers the access side in a rest position and which is moved from the rest position into an open position when a complimentary plug device element is inserted into the contact module.

With the electrical plug device according to the invention and the described method, a contact module is advantageously protected by a cover element when not in use, while this cover element is "automatically" moved to an open position, i.e. when a complimentary plug device element is inserted, thus enabling the plug-in operation. No additional activity is required from the user aside from the normal insertion of the complimentary plug device element, for example a hinged cover need not be opened. This improves the operating comfort and allows the complimentary plug device element to be plugged in with one hand. In addition, safety is also enhanced, because the elimination of a bothersome operating step also eliminates the risk that the protective mechanism is improperly defeated by the user.

The "automatic" movement of the cover element from the rest position into the open position is caused by the insertion of the complimentary plug device element. Auxiliary energy may be employed, for example through activation of an electrical drive. However, the required energy for moving the cover element is typically provided by the inserted complimentary plug device element, meaning in fact by the user.

Various modifications of the invention will now be described, which can likewise be applied to and used for the electrical plug device, for its closure device and for the method.

According to a first preferred embodiment, the cover element is moved from the rest position into the open position by the movement of a complimentary plug device element inserted into the contact module along the insertion axis. In this variant, the movement of the complimentary plug device element then provides the energy for moving the cover element. In addition, the closure device is advantageously opened solely by the "normal" movement of the plug device element in the direction of the insertion axis, i.e. without additional movements, such as pivoting or rotating the plug device element before or during insertion.

The cover element may be constructed and movably supported in different ways. For example, the cover element may be pivotally supported for pivoting about one or several pivot axes, wherein the pivot axes may in particular be oriented parallel or perpendicular or with any other angled orientation with respect to the insertion axis. When several cover elements are provided, each cover element may be supported on a dedicated individual pivot axis, or two or more of the cover elements may be supported on a common pivot axis.

Alternatively, the cover element may be supported for linear movement in a guide. A linear movement of the cover element may preferably be perpendicular to the insertion axis, so that the cover element can be pulled out of the access side as quickly as possible.

According to a particularly preferred embodiment, the cover element has a sliding surface oriented at an angle with respect to the insertion axis, with a complimentary plug device element coming into contact with the sliding surface when the contact module is inserted. The slope of the sliding surface applies an outwardly oriented force component on the cover element during the plug-in process, urging the cover element from the rest position into the open position. The sliding surface may optionally be also very narrow, i.e. approximately have the form of a line.

The cover element is preferably pretensioned toward the rest position, so that it automatically assumes the rest position in the absence of external forces. The pretension may be produced, for example, by a spring element acting on the cover element.

While the closure device can fundamentally be realized using a single cover element, two or more cover elements are preferably used. This reduces the distance to be traveled by each individual cover element from the rest position to the open position. In a particular preferred embodiment, the plurality of cover elements is arranged symmetrically with respect to the insertion axis. In this way, forces which deflect a complimentary plug device element away from the insertion axis can be eliminated during the plug-in process.

When the closure device has at least two movable cover elements, these cover elements advantageously interlock in their contact region when in the rest position. Such interlocking arrangement can be realized, for example, with a tongue-and-groove structure. The interlocking engagement increases the stability in the rest position and improves sealing against incursion of contaminants and/or humidity.

According to another preferred embodiment of the invention, the cover element is arranged protected behind a faceplate, i.e. between the faceplate and the contact module. In particular, the faceplate may be part of a housing in which the contact module is installed. Preferably, the faceplate does not exposed more than the cross-sectional area necessary for inserting a complimentary plug device element into the contact module. In this case, the cover element disappears completely behind the faceplate in its open position. The cover element and the support mechanism are then optimally protected from disturbances.

According to another preferred embodiment of the invention, the plug device element may include a drive for actively moving the cover element from the rest position into the open position or vice versa. In particular, an electrically operated actuator (motor) may be provided for this purpose, which is triggered by a suitable switching mechanism when a complimentary plug device element is inserted or approaches.

In addition, the cover element may optionally be lockable in the rest position. The cover element can then be moved into the open position and the plug-in process can be performed only after the lock is released. Locking thus provides an additional safety measure for the plug device against unauthorized and/or improper use. The locking mechanism may be controlled, for example, by a key to be applied by the user. In particular, the locking mechanism may also be controlled by an electronic control configured to check authorization of a user.

BRIEF DESCRIPTION OF THE DRAWING

The invention will now be described with reference to particular embodiments illustrated in the figures, which show in.

DETAILED DESCRIPTION OF PREFERRED EMBODIMENTS

Figure 4:
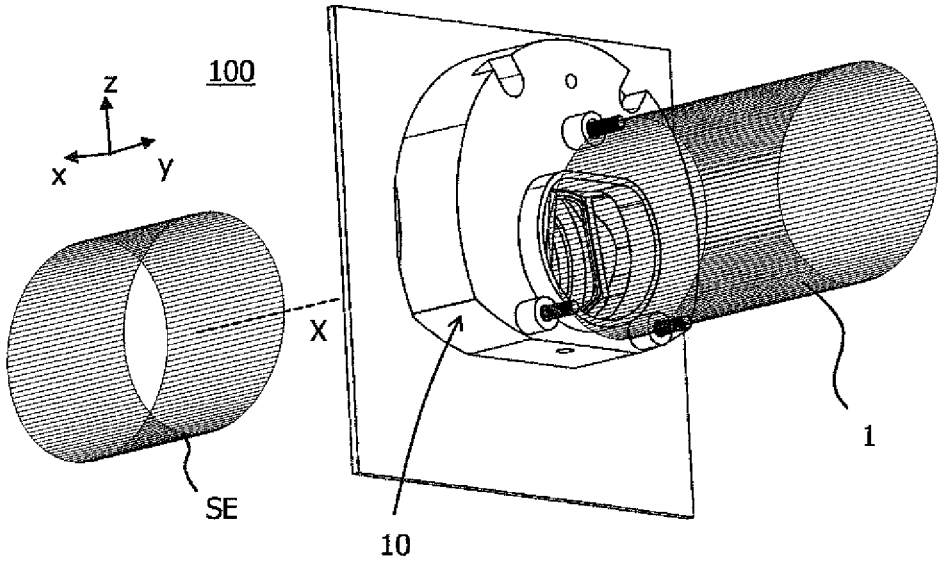
FIG. 4 the plug device of FIG. 3, with the cover elements of the closure device in the open position, and with an indicated contact module and a complimentary plug device element.

The plug device 100 illustrated in FIGS. 1 to 6 in different views in its entirely or partially includes the following components:

- A contact module 1 schematically illustrated in FIG. 4. The contact module 1 may be constructed, for example, as a socket part with electrical contact sockets. Suitable embodiments of contact modules are known from conventional plug devices. For the sake of clarity, the contact module has been omitted in all other figures.
- An optional face plate 2, which may, for example, be the front side of an unillustrated housing in which the plug device is installed.
- A closure device 10 arranged between the faceplate 2 and the contact module 1.

A complimentary plug device element (indicated as "SE" in FIG. 4) may be inserted into the plug device element 100 from the front side along a insertion axis X through an "access side" ZS into the contact module 1, with the closure device 10 selectively closing or opening the access side ZS. The aforementioned access side is enclosed in FIG. 4 by the collar located on the backside of the closure device 10 and indicated as "ZS". The closure device 10 will be described in more detail below with particular reference to FIGS. 5 and 6.

The closure device 10 includes two cover elements 11*a*, 11*b* which in the rest position (FIGS. 1, 3, 5) are positioned in front of the access side ZS of the contact module 1 and thus protectively close the contact module 1. Preferably, this approach provides protection according to the standard IP44.

The two cover elements 11*a*, 11*b* are supported at a common hinge point 23 behind the faceplate 2. The hinge point 23 enables the cover elements 11*a*, 11*b* to pivot about a pivot axis A which extends parallel to the insertion axis X.

Preferably, a spring element, such as an (unillustrated) leg spring, which pretensions the cover elements 11*a*, 11*b* in the rest position, is arranged at the hinge point 23. The cover elements can then move apart into the open position only against a restoring force.

Figure 5:
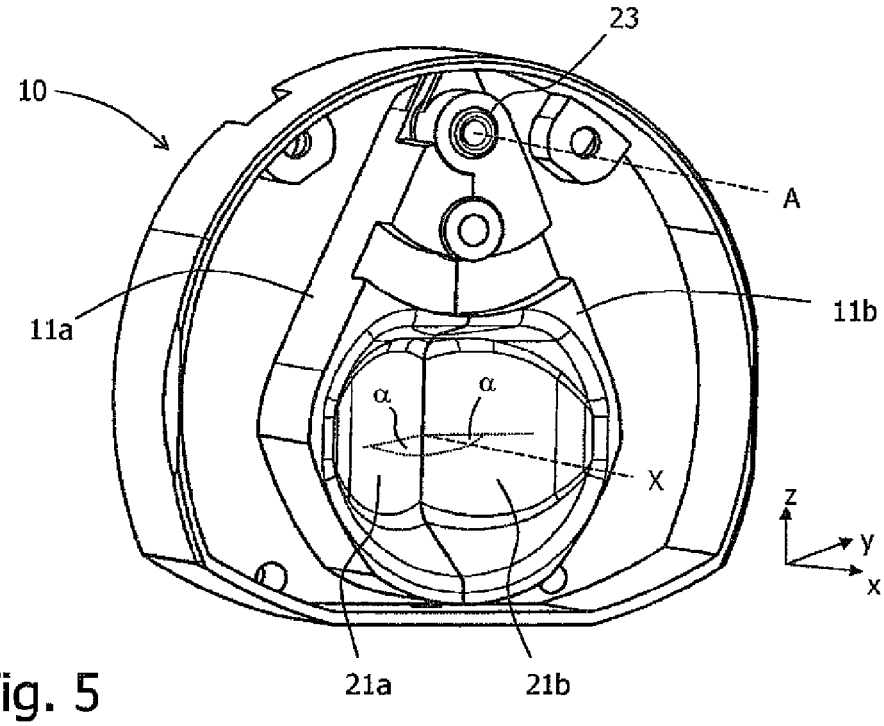
FIG. 5 a separate perspective front view onto the cover elements of the closure device in the rest position, with the faceplate removed.

As indicated in FIG. 5, the two cover elements 11*a*, 11*b* preferably have inclined sliding faces 21*a*, 21*b*, which are oriented in form of a funnel in the direction of the contact module and typically form an angle $\alpha$ of between 20° and 80°, particularly preferred between 40° and 50°, with respect to the insertion axis. A complimentary plug device element SE, for example a plug, inserted into the plug device then slides on the inclined surfaces 21*a* and 21*b* when moved along the insertion axis X, pressing the cover elements 11*a*, 11*b* radially outwardly away from the insertion axis X into an open position. Advantageously, this occurs "automatically" when the plug device element SE is inserted normally, i.e. during a movement along the straight insertion axis X.

Figure 6:
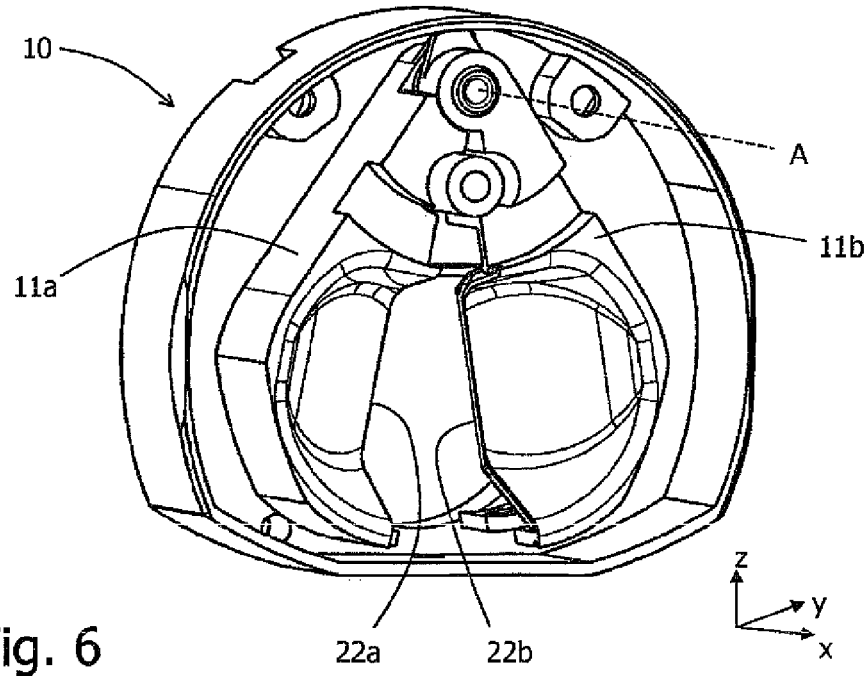
FIG. 6 a separate perspective front view onto the cover elements of the closure device in the open position, with the faceplate removed.

As indicated in FIG. 6, the cover elements 11*a* and 11*b* have in their contact region a groove 22*b* and a corresponding land 22*a*, which interlock in the rest position according to the tongue-and-groove principle. This increases the sealing capability and the stability of the arrangement.

It will be understood that the cover elements 11*a*, 11*b* can also be constructed different from the illustration, for example, only line-shaped contact lands may be provided instead of the sliding surfaces 21*a*, 21*b*. In addition, a different number of cover elements may be present, or the cover elements may be pivotable above other axes or may be linearly movable.

Figure 1:
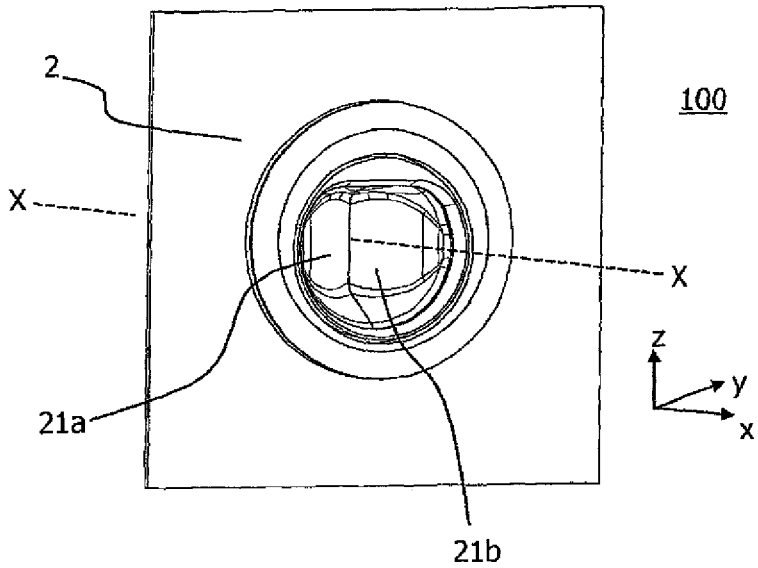
FIG. 1 a perspective front view of an electrical plug device according to the present invention, with the cover elements of the closure device in the rest position.
Figure 2:
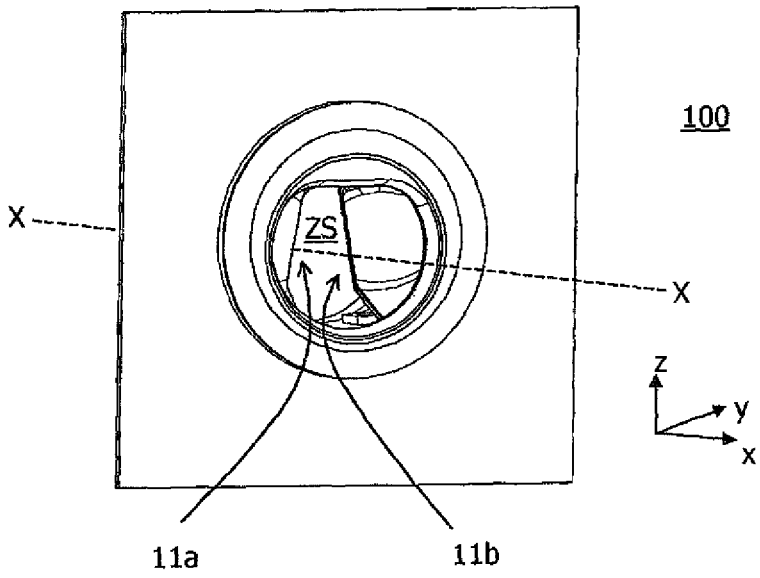
FIG. 2 the plug device of FIG. 1, with the cover elements of the closure device in the open position.
Figure 3:
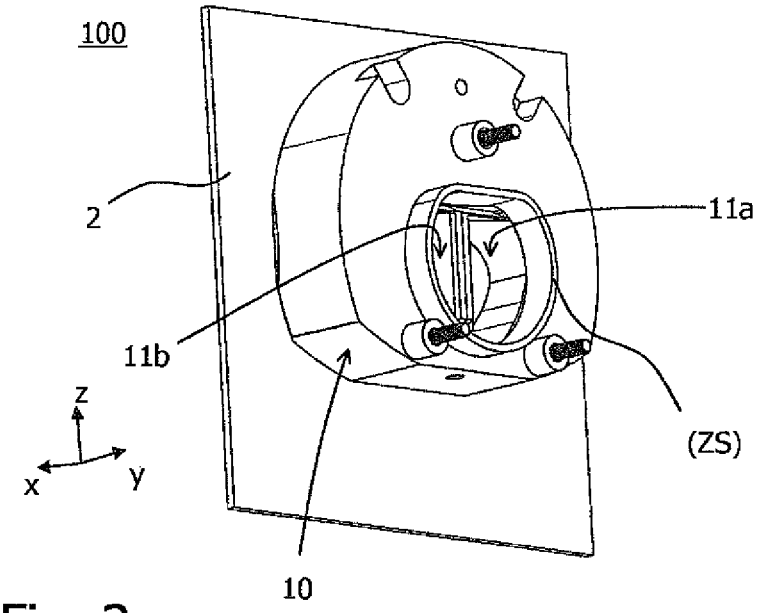
FIG. 3 a perspective view of the plug device of FIG. 1, with the cover elements of the closure device in the rest position.

As seen in FIG. 1, the closure device 10 with the cover elements 11*a*, 11*b* is located behind the faceplate 2, so that the entire mechanism of this device is optically and mechanically protected by the faceplate 2.

The invention claimed is:

1. An electrical plug device comprising:

a contact module having an access side providing access to at least two contact elements and configured for insertion of a complimentary plug device element into the contact module through movement of the complimentary plug device element along an insertion axis extending substantially through a center of the contact module; and a closure device having at least two cover elements which are supported for pivoting about a pivot axis that is parallel to the insertion axis and has an offset from the insertion axis, wherein each of the cover elements comprises a sliding surface positioned at an angle with respect to the insertion axis and is configured for movement from a rest position, where the cover element covers at least a portion of the access side of the contact module, into an open position, wherein the cover element uncovers the portion of the access side when the complimentary plug device element is inserted into the contact module and contacts the respective sliding surfaces.

2. The plug device of claim 1, wherein the at least two cover elements have a pretension urging the at least two cover elements into the rest position.

3. The plug device of claim 1, wherein the at least two cover elements are arranged symmetrically with respect to the insertion axis.

4. The plug device of claim 1, comprising at least two cover elements, each cover element having a contact region, wherein the at least two cover elements engage with their corresponding contact regions.

5. The plug device of claim 1, comprising a drive for actively moving the at least two cover elements from the rest position into the open position or vice versa.

6. The plug device of claim 1, wherein the at least two cover elements are arranged between the contact module and a faceplate.

7. The plug device of claim 1, wherein the at least two cover elements are lockable in the rest position.

8. A closure device for a plug device, wherein the plug device comprises a contact module having an access side providing access to at least two contact elements and configured for insertion of a complimentary plug device element into the contact module through movement of the complimentary plug device element along an insertion axis extending substantially through a center of the contact module, the closure device comprising:

at least two cover elements which are supported for pivoting about a pivot axis that is parallel to the insertion axis and has an offset from the insertion axis, wherein each of the cover elements comprises a sliding surface positioned at an angle with respect to the insertion axis and is configured for movement from a rest position, where the cover element covers at least a portion of the access side of the contact module, into an open position, wherein the cover element uncovers the portion of the access side when the complimentary plug device element is inserted into the contact module and contacts the respective sliding surfaces.

9. The closure device of claim 8, wherein the at least two cover elements have a pretension urging the at least two cover elements into the rest position.

10. The closure device of claim 8, wherein the at least two cover elements are arranged symmetrically with respect to the insertion axis.

11. The closure device of claim 8, comprising at least two cover elements, each cover element having a contact region, wherein the at least two cover elements engage with their corresponding contact regions.

12. The closure device of claim 8, comprising a drive for actively moving the at least two cover elements from the rest position into the open position or vice versa.

13. The closure device of claim 8, wherein the at least two cover elements are arranged between the contact module and a faceplate.

14. The closure device of claim 8, wherein the at least two cover elements are lockable in the rest position.

* * * * *